US006203267B1

(12) United States Patent
Heiple et al.

(10) Patent No.: US 6,203,267 B1
(45) Date of Patent: Mar. 20, 2001

(54) MATERIAL HANDLING ASSEMBLY FOR MACHINES AND THUMB ASSEMBLY THEREOF

(75) Inventors: Ashley Heiple, Alum Bank; Don Keller, Bedford, both of PA (US); Peter Lalos, Gaithersburg, MD (US)

(73) Assignee: Rockland Inc., Bedford, PA (US)

( * ) Notice: Subject to any disclaimer, the term of this patent is extended or adjusted under 35 U.S.C. 154(b) by 0 days.

(21) Appl. No.: 09/366,621

(22) Filed: Aug. 3, 1999

(51) Int. Cl.[7] ..... E02F 3/96
(52) U.S. Cl. ..... 414/722; 37/403; 37/406
(58) Field of Search ..... 414/704, 722, 414/724, 740; 37/403, 903

(56) References Cited

U.S. PATENT DOCUMENTS 4,407,626 * 10/1983 Bruckner ..... 414/740
4,558,515 * 12/1985 LaBounty ..... 414/740
5,544,435 * 8/1996 Somero ..... 414/724
5,553,408 * 9/1996 Townsend ..... 414/722
5,678,332 * 10/1997 Hawkins ..... 414/722
5,927,933 * 7/1999 Tucker ..... 414/724

* cited by examiner

*Primary Examiner*—Gregory A. Morse
(74) *Attorney, Agent, or Firm*—Lalos & Keegan; Michael N. Lau

(57) ABSTRACT

A material handling assembly mountable on the handle of a machine generally having a bucket pivotally connectable to the handle and a device for pivoting the bucket about the pivotal connection of the bucket to the handle, an arm member pivotally connectable to the handle and cooperable with the bucket when mounted on the handle for clamping material therebetween, a bracket mountable on the handle having a guideway therein, a strut having a first section pivotally connected to the arm member and a second section received within and displaceable along the guideway, and a device for detachably securing the second section of the strut to the bracket at selected points along the length of the guideway.

22 Claims, 3 Drawing Sheets

MATERIAL HANDLING ASSEMBLY FOR MACHINES AND THUMB ASSEMBLY THEREOF

This invention relates to a material handling assembly mountable on the handle of a machine such as an excavating machine, and more particularly to such an assembly which is operable to clamp, grasp or grapple, various materials such as soil, rocks, tree trunks, tree stumps, debris and the like between a pair clamping members. The invention further contemplates an adjustable implement in the form of an arm member comprising a component of such an assembly.

BACKGROUND OF THE INVENTION

In the prior art, there has been developed a type of implement commonly referred to as a "thumb", mountable on the underside of the handle of an excavating machine which is cooperable with the bucket of the machine for grasping material being handled between the thumb and the bucket. Typically, the thumb is fixed relative to the handle and the bucket may be curled and uncurled to grasp and hold the material being handled. The thumb also is usually connected to the handle with a strut which may be either of a fixed or extendable length to permit adjustment of the angle of the thumb relative to the handle. The strut may consist of rigid link detachably securable to one of a number of brackets deposed on the underside of the handle or a hydraulic cylinder whose length may be varied and locked to position the thumb at the desired angle.

Utilizing a hydraulic cylinder for adjusting the angle of the thumb has a number of advantages but is comparatively costly. Utilizing a rigid strut and a number of connecting brackets also has a number of advantages but presents a number of disadvantages including increased cost of manufacture and installation and a certain amount manual labor being required in fixing the desired angle of the thumb and securing it into position. It thus has been the principal object of the present invention to provide a material handling assembly of the type described having a thumb component which is simple in construction, comparatively easy to install and readily adjustable. It is a further object of the invention to provide such an implement which may be easily set at a desired angle for operational purposes and conveniently retracted and positioned against the underside of the handle for storage purposes, permitting the bucket of the assembly to be operated independently of the thumb member.

SUMMARY OF THE INVENTION

The present invention overcomes some of the disadvantages of prior art material handling assemblies of the type described by providing an assembly mountable on the handle of the machine consisting generally of a bucket pivotally connectable to the handle of the machine and the means for pivoting the bucket about the pivotal connection of the bucket to the handle, an arm member pivotally connectable to the handle and cooperable with the bucket when mounted on the handle for clamping material being handled therebetween, a bracket mountable on the underside of the handle, having a guideway therealong, a strut having a first end thereof pivotally connected to the arm member and second end thereof received within and displaceable along the guideway, and means for detachably securing the second end of the strut to the bracket at selected points along the length of the guideway.

DESCRIPTION OF THE PREFERRED EMBODIMENTS OF THE INVENTION

Figure 1:
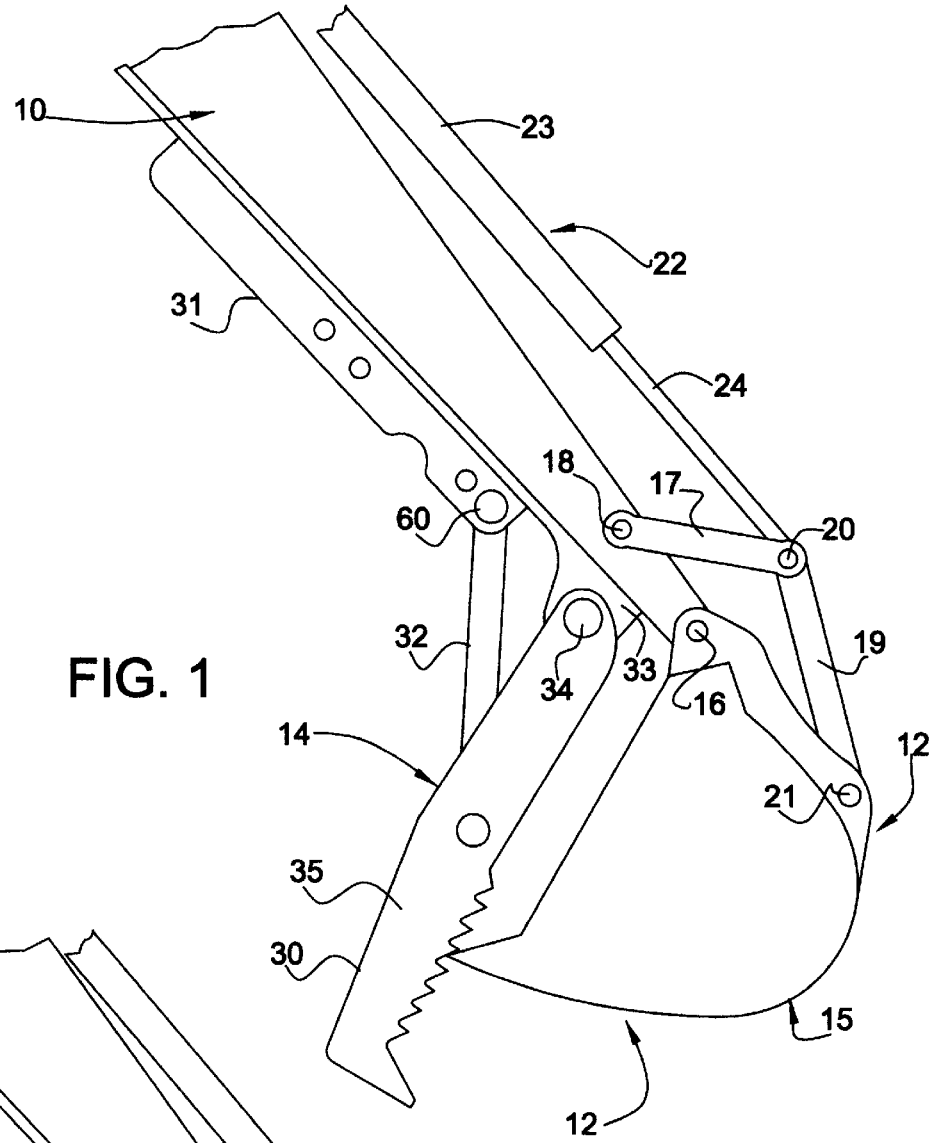
FIG. 1 is a partial elevational view of the front end assembly of an excavating machine incorporating an embodiment of the invention and illustrating the components thereof in a closed or clamping condition with the thumb component thereof disposed in an extended position.

Referring to FIGS. 1 through 4 of the drawings, there is illustrated a front end assembly of an excavating machine which generally includes a handle 10 and material handling assembly 12 operatively mounted on the handle. The handle is of a conventional construction and is supported on the frame of the machine so that it may be pivoted about vertical and horizontal axes to position the material handling assembly in the conventional manner. The material handling assembly includes a bucket assembly 13 and a thumb assembly 14.

The bucket assembly is of a conventional construction and includes a bucket 15 connected to the free end of the handle by means of a shaft 16, a support link 17 pivotally connected to the handle by means of a connecting pin 18, a connecting link 19 interconnecting support link 17 and bucket 15 by means of connecting pins 20 and 21 and a hydraulic cylinder assembly 22. The cylinder assembly includes a cylinder member 23 pivotally connected at the base end thereof to a bracket mounted on the upper side of the handle, and a rod member 24 pivotally connected to connecting pin 20. The cylinder assembly is adapted to be extended and retracted in the conventional manner to pivot and thereby curl and uncurl the bucket about the axis of shaft 16.

Figures 3, 4:
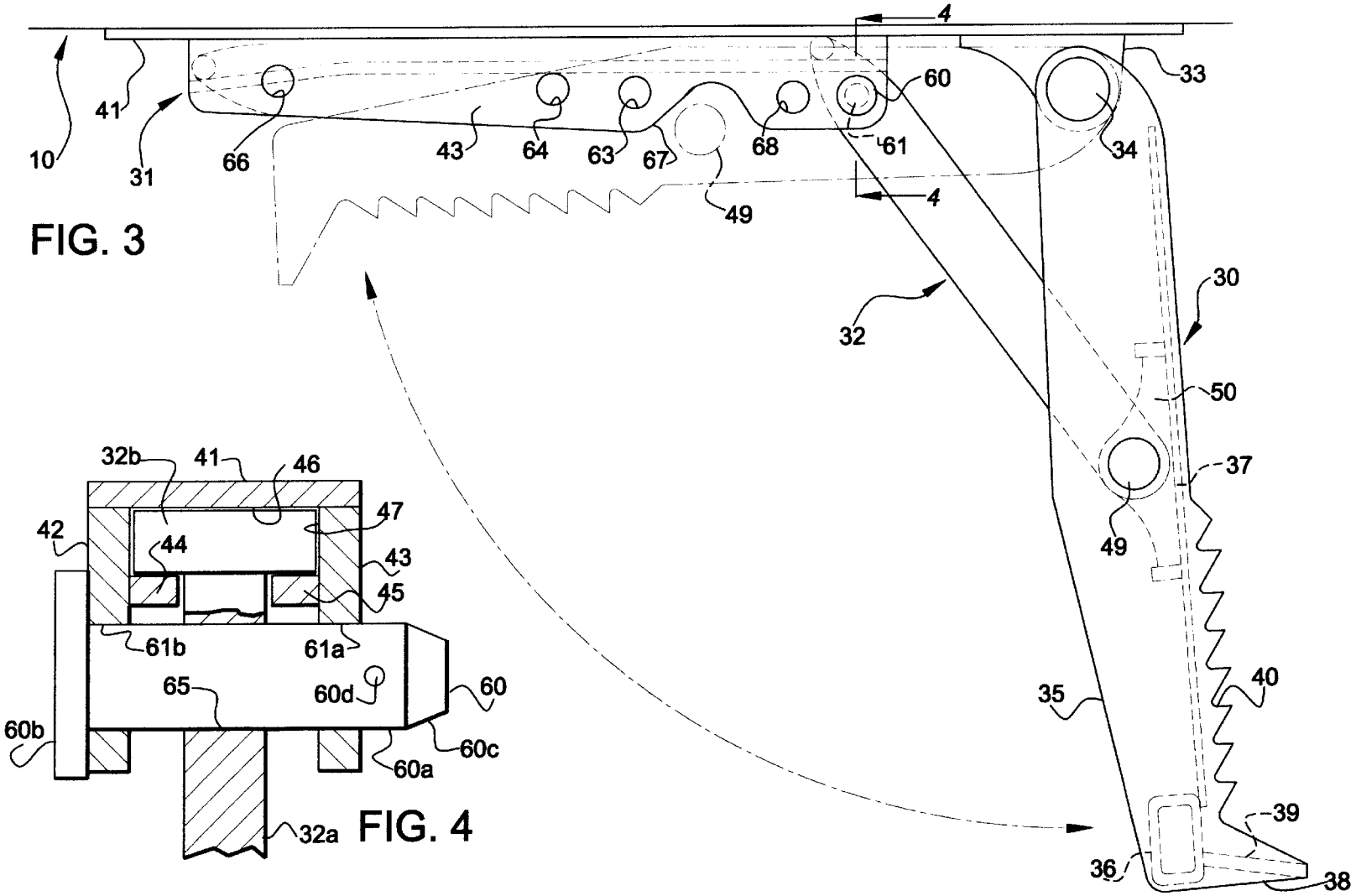
FIG. 3 is an enlarged, side elevational view of the thumb assembly shown in FIGS. 1 and 2, illustrating the thumb component thereof in an extended position.
FIG. 4 is an enlarged cross-section taken along line 4—4 in FIG. 3.

Thumb assembly 14 generally includes an arm member 30 pivotally connected to the underside of the handle adjacent shaft 16, a bracket 31 mounted on the underside of the handle rearwardly of the pivotal connection of the arm member to the handle and a rigid strut 32 operatively interconnecting the arm member and the bracket. The arm member is pivotally connected to a depending bracket 33 rigidly secured to the underside of the handle by means of a connecting pin 34. The axes of pin 34 and shaft 16 are disposed parallel and are positioned apart and at an appropriate angle to permit the arm member and bucket to come together at different angular positions of the arm member to facilitate the clamping of material being handled therebetween. The arm member consists of a pair of transversely spaced, side wall sections 35, 35 pivotally connected at inner ends to connecting pin 34, secured together and reinforced at the outer ends thereof by means of a box-shaped spacer 36 and closed along one set of edges by means of an end wall section 37. As best shown in FIG. 3, the outer ends of the side wall sections are provided with projecting, pointed portions 38, 38 interconnected by a spacer and reinforcing plate 39 which also is secured along its rear edge to box-shaped spacer 36. A portion of the outer edges of side wall sections 35, 35 project beyond the plane of the outer surface of end wall section 37 and are provided with a jagged or serrated configuration as at 40 for enhancing the gripping capability of the arm member when cooperating with the bucket to clamp material being handled therebetween.

Bracket 31 includes a base section 41 rigidly secured by welding or bolts to the underside of handle 10, and a pair transversely spaced, depending walls sections 42 and 43. As best seen in FIG. 4, a pair of strips 44 and 45 spaced from base section 41 and projecting inwardly from side wall sections 42 and 43 provide a T-shaped guideway 46 disposed along the length of the bracket, including a head portion 47 and neck portion 48.

Strut 32 consists of an elongated, rigid member having one end received between the side wall sections of arm member 30 and connected by means of a connecting pin 49 to a bracket 50 rigidly secured to the inner side of end wall section 37. The opposite end of strut 32 is provided with a narrow shank portion 32*a* received through neck portion 48 and a head portion 32*b* received within and displaceable along guideway head portion 47. Head portion 32*b* has a cylindrical configuration enabling it to slide freely along the length of head portion 47 of guideway 46 when the arm member is pivoted. Inwardly projecting strip portions 44 and 45 prevent the head portion of the strut from becoming detached from of the bracket, and neck opening 48 freely permits shank portion 32*a* of the strut to displace longitudinally relative to the bracket and pivot about the axis of cylindrical head section 32*b*.

When arm member 30 is pivoted about the axis of connecting pin 34 between the positions shown in solid and phantom lines in FIG. 3, the upper end portion of the strut member will be caused to be displaced along the length of guideway 46 to position the arm member at various angles relative to the handle. The angular position of the arm member relative to the handle may be fixed by means of a locking pin 60 insertable through registerable openings in the side wall sections of bracket 31 and an opening in the shank portion of strut 32 Side wall sections 42 and 43 are provided with longitudinally spaced sets 61 through 64 of transversely aligned openings which are adapted to register with opening 65 in the shank portion of strut 32. As the arm member is pivoted about connecting pin 34 causing strut 32 to slidably displace head portion 32*b* of strut 32 along portion 47 of guideway 46, locking pin 60 may be inserted through the registered openings to lock the arm member in the selected angular position relative to the handle.

Locking pin 60 is provided with a cylindrical shank portion 60*a* insertable through registered openings in the side wall sections of the bracket and the shank portion of the strut, and a head portion 60*b*. As illustrated in FIG. 4, the shank portion 60*a* of the locking pin is received through registered openings 61*b*, 65 and 61*a* with head portion 60*b* engaging the outer surface of side wall section 42 to lock the upper end of the strut member relative to the bracket and thus fix the angle of the arm member relative to the handle. The free end of shank portion 60*a* is tapered as at 60*c* to facilitate the insertion of the pin, and the free end of the shank portion of the locking pin is provided with an opening 60*d* therethrough through which a pin may be inserted to prevent the locking pin from becoming removed from the registered openings in the bracket and the strut.

When the arm member is retracted to its rearmost position as illustrated in phantom lines in FIG. 3, bracket 31 is adapted to be received within the arm member between side walls 35, 35, and head portion 32*b* of the strut will be caused to be displaced to the rearward end of head portion 47 of guideway 46. The arm member may be retained in such storage position adjacent the underside of handle 10 by means of locking pin 60 inserted through a set 66 of transversely aligned openings in the side wall sections of the bracket, and opening 65 in the shank portion of the strut. As best shown in FIG. 3, the lower edges of the side wall sections of bracket 31 are provided with a set of transversely aligned recesses 67 which are adapted to receive and thus accommodate connecting pin 49 when the arm member is retracted to its storage position as illustrated by the phantom lines in FIG. 3.

Figure 2:
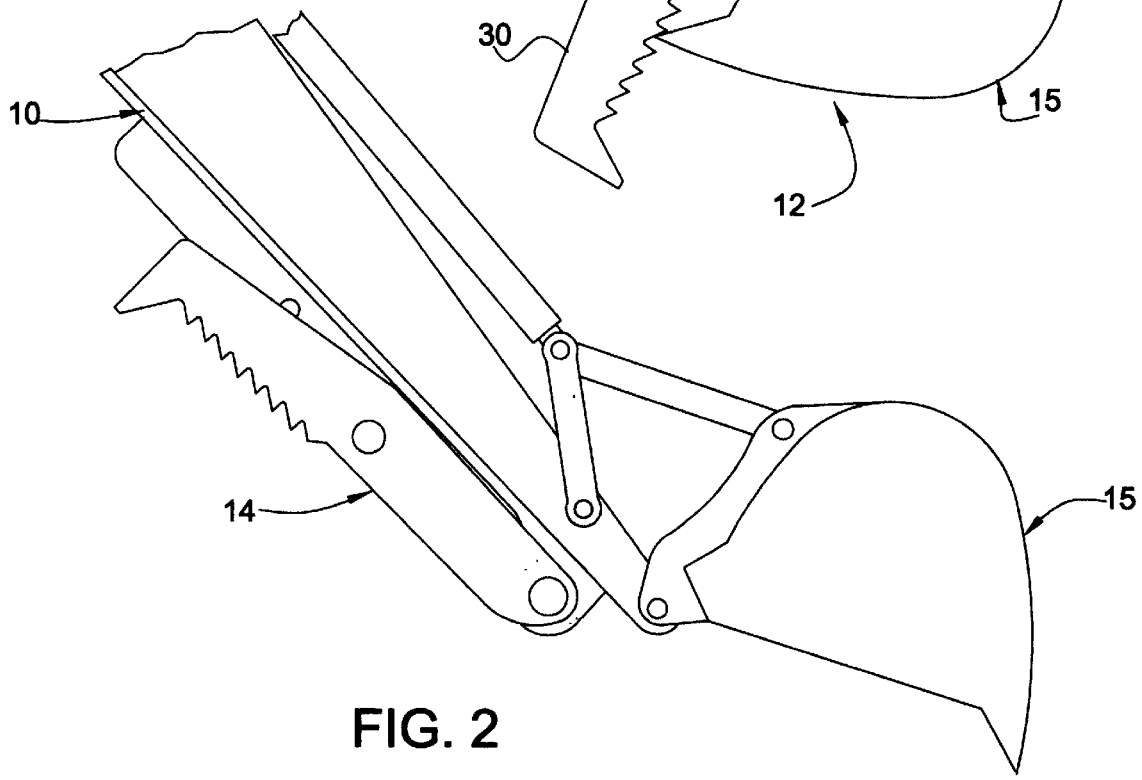
FIG. 2 is a view similar to the view shown in FIG. 1 illustrating the components in an open or unclamped condition with the thumb component thereof disposed in a fully retracted, storage position.

Under normal operating conditions of the excavating machine, the arm member will be retracted and retained in the storage position as shown in FIG. 2 to permit the bucket to be curled and uncurled in the conventional manner to perform a digging operation. Under such conditions, the arm member being fully retracted and positioned along the underside of the handle will not interfere with the curling and uncurling action of the bucket. When it is desired to perform a material handling function with the use of the thumb assembly, the bucket is first uncurled so as not to interfere with the positioning of the arm member, locking pin 60 is removed to free the arm member and allow it to swing downwardly and engage the ground, the handle is maneuvered while the tip of the arm member engages the ground to cause head portion 32*b* to slide along portion 47 of the guideway and position opening 65 in the shank portion of the strut in registry with a selected one of sets 61 through 64 and locking pin 60 is inserted in the selected registered openings to fix the angle of the arm member relative to the handle and thus lock it in such position. The handle may thus be maneuvered and coordinated with the curling and uncurling of the bucket to grasp, transport and release material being handled.

When the material handling operation has been completed and it is desired to reposition the arm member to its storage position, the bucket is first uncurled to remove it from the vicinity of the arm member, the arm member is manipulated to dig the end of the arm member into the ground to relieve the force on the locking pin, the locking pin is manually removed, the handle is further manipulated to cause the arm member to pivot and be positioned against the underside of the handle and the locking pin is then reinserted in a set of registered openings adjacent the rear end of the bracket to secure the arm along the underside of the handle.

Figures 5, 6:
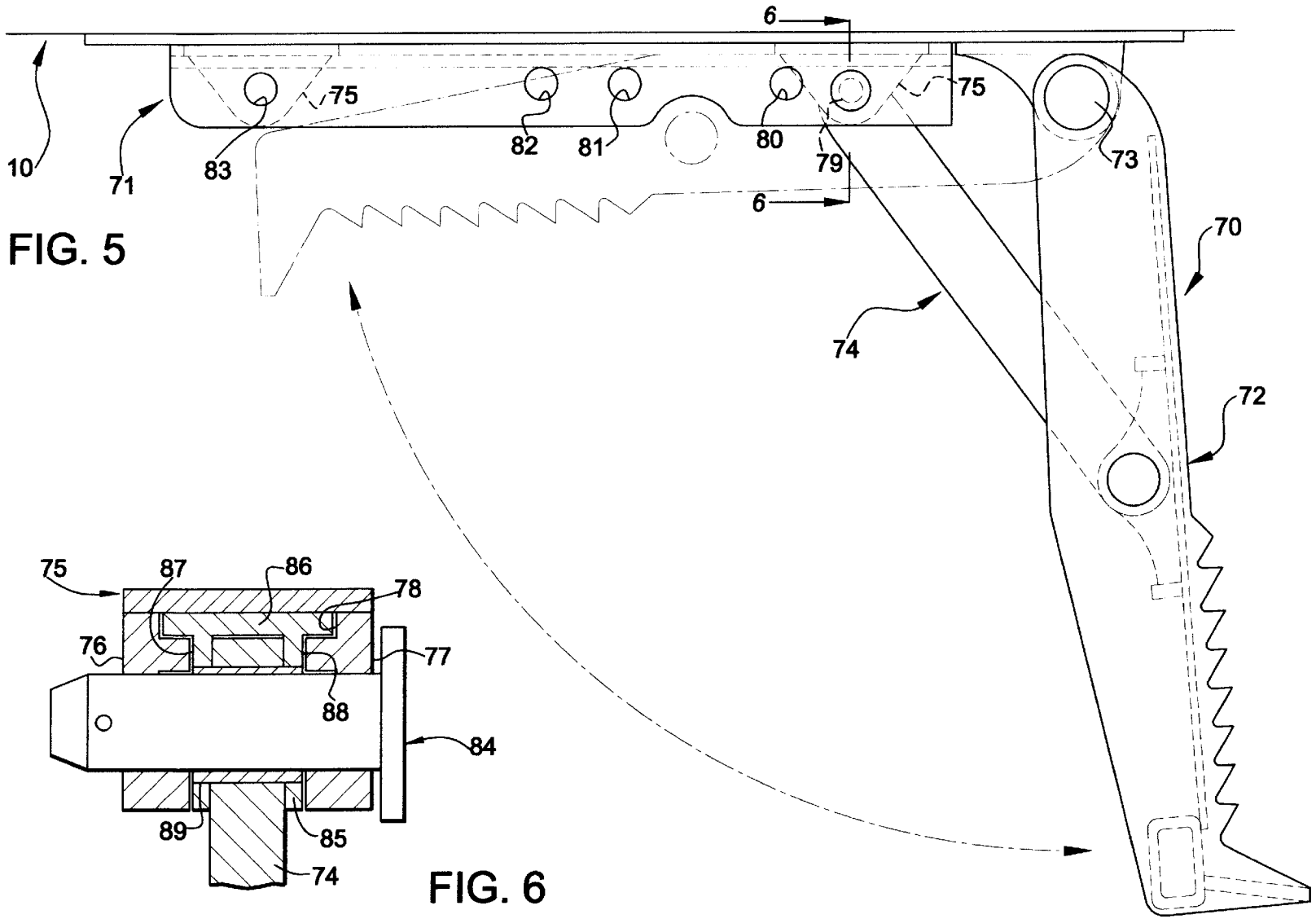
FIG. 5 is a view similar to the view shown in FIG. 3, illustrating another embodiment of the invention.
FIG. 6 is an enlarged cross-sectional view taken along line 6—6 in FIG. 5.

Referring to FIGS. 5 and 6, there is illustrated another embodiment of the invention, the embodiment consists of a thumb assembly 70 comparable in construction and operation to thumb assembly 14, mountable on the underside of handle 10 and similarly cooperable with bucket 15 for grasping, transporting, and releasing a variety of materials. The assembly includes a bracket 71 mounted on the underside of the handle, an arm member 72 substantially identical to arm member 30, pivotally connected to a bracket 73 depending from the underside of the handle adjacent the connection of the bucket to the handle by means of a connecting pin 73, and a rigid strut 74. As best shown in FIG. 6, bracket 71 includes an elongated base section 75 secured to the underside of the handle by welding or bolting, and a pair of transversely spaced, depending side wall sections 76 and 77. The upper, inner surfaces of the side wall sections are recessed along the lengths thereof to provide a longitudinal guideway 78 having a T-shaped cross sectional configuration. The side wall sections further are provided with a plurality of longitudinally spaced sets 79 through 83 of transversely aligned openings adapted to receive a locking pin 84 similar to locking pin 60.

Disposed within and slidably displaceable along the length of guideway 78 is a retainer member 85 having a head section 86 received within the upper, enlarged portion of the guideway and a pair of transversely spaced, depending sections 87 and 88 received within the neck portion of the guideway. Received between side wall sections 87 and 88 is the upper end of strut 74 which is provided with a transverse opening aligned with a set of openings in wall sections 87 and 88. A bushing 89 is inserted in such aligned openings to pivotally connect the upper end of the strut to retainer member 86. It will be appreciated that as the retainer member is slidably displaced along guideway 78, the arm member will be caused to pivot about the axis of retaining pin 73 relative to the handle. To facilitate the pivotal movement of the upper end of the strut relative to the retainer member, the upper end of the strut is rounded so as to avoid interference with the connected retainer member.

As in the previous embodiment, the angle of the arm member may be adjusted merely by displacing the retainer member along the guideway so that bushing 89 registers with the openings of one of the sets 79 through 83, and inserting locking pin 84 in the registered openings. When it is desired to fully retract and store the arm member, the retainer member may be caused to be displaced to its rearmost position to corresponding position the arm member in the position illustrated by the phantom lines in FIG. 5 and align bushing 89 with the openings of set 83, and the locking pin may be inserted in such registered openings. Also, as in the previous embodiment, bracket 71 will be received within the side wall sections of the arm member to position the arm member close to the underside of the handle, clear of the bucket as it is curled and uncurled in a conventional digging operation. By the use of a rounded end portion of the strut received within the guideway, and a pivotal connection of the upper end of the strut member with a separate, slidably displaceable retainer member, binding of the upper end of the strut relative to the bracket as it slidably displaces along the length thereof, is avoided permitting the arm member to be freely pivoted about its pivotal connection to the underside of the handle.

In a further embodiment of the invention, the retainer member is elongated and provided with a plurality of transversely disposed, longitudinal spaced openings, each adapted to register with a single set of transversely aligned openings in depending wall sections of the bracket, and the upper end of the strut is pivotally connected to a portion of the retainer member extending through the throat portion of the T-shaped guideway in the retainer member. Either a locking pin comparable to locking pins 60 and 84 may be inserted in such registered openings to lock the retainer member relative to the bracket and correspondingly fix the angle of the arm member relative to the handle or such registered openings may be adapted to receive the plunger of an electrically actuated solenoid mounted on a side wall section of the bracket. With the use of a solenoid, an electrical system may be used to enable the operator to remotely adjust the angle of the arm member simply by maneuvering the handle of the machine and the electrical controls of the solenoid.

It is contemplated that the components of the thumb assembly be constructed of high strength steel and formed by casting and/or fabricating. The brackets to which the arm member and strut member are connected may be either welded or bolted to the underside of the handle. The components of the thumb assembly further may be assembled and sold as a kit, enabling purchasers to install such assemblies in the field.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. A material handling assembly mountable on the handle of a machine comprising:

a bucket pivotally connectable to said handle and means for pivoting said bucket about the pivotal connection of said bucket to said handle;

an arm member pivotally connectable to said handle and cooperable with said bucket when mounted on said handle for clamping material therebetween;

a bracket mounted on said handle having a guideway therein;

a strut having a first section pivotally connected to said arm member and a second section received within and displaceable along said guideway; and means for detachably securing said second section of said strut to said bracket at selected points along the length of said guideway.

2. An assembly according to claim 1 wherein said detachable securing means comprises a pin insertable in registerable openings in said bracket and said strut when said bracket and said arm member are mounted on said handle.

3. An assembly according to claim 1 wherein said bracket is mountable on the underside of said handle.

4. An assembly according to claim 1 wherein said detachable securing means includes a retainer member disposed in said guideway and displaceable along the length thereof, and said second section of said strut is pivotally connected to said retainer member.

5. An assembly according to claim 4 wherein said detachable securing means includes a pin insertable in registerable openings in said bracket, said retainer member and said second section of said strut.

6. An assembly according to claim 4 wherein said guideway has a T-shaped cross sectional configuration and said retainer member has a complimentary cross sectional configuration.

7. An assembly according to claim 6 wherein said detachable securing means includes a pin insertable in registerable openings in said bracket, said retainer member and said second section of said strut.

8. An assembly according to claim 1 wherein said second section of said strut includes an end portion received within, slideable along and having a cross sectional configuration complimentary to the cross sectional configuration of said guideway, and said detachable securing means includes a pin insertable in registerable openings in said bracket and said second section of said strut.

9. An assembly according to claim 8 wherein said end portion has a T-shaped cross sectional configuration.

10. An assembly according to claim 9 wherein said end portion includes a head segment having a cylindrical configuration and a shank section, and wherein said pin is insertable in registerable openings in said bracket and said shank portion.

11. An assembly according to claim 1 wherein said arm member is provided with a pair of transversely spaced wall sections, and wherein said bracket is received between said wall sections when said bracket and arm member are mounted on said handle and said strut is connected to said bracket at a point disposed furthermost from the pivotal connection between said arm member and said handle.

12. An assembly mountable on a maneuverable handle of a machine to perform various work functions comprising:

an arm member pivotally connectable to said handle;

a bracket mountable on said handle, having a guideway therein;

a strut having a first section pivotally connected to said arm member and a second section received within and displaceable along said guideway; and means for a detachably securing said second section of said strut to said bracket at selected points along the length of said guideway.

13. An assembly according to claim 12 wherein said detachable securing means comprises a pin insertable in registerable openings in said bracket and said strut when said bracket and strut are mounted on said handle.

14. An assembly according to claim 12 wherein said bracket is mountable on an underside of said handle.

15. An assembly according to claim 12 wherein said detachable securing means includes a retainer member disposed in said guideway and slideable along the length thereof, and said second section of said strut is pivotally connected to said retainer member.

16. An assembly according to claim 15 wherein said detachable securing means includes a pin insertable in registerable openings in said bracket, said retainer member and said second section of said strut.

17. An assembly according to claim 15 wherein said guideway has a T-shaped cross sectional configuration and said retainer member has a complimentary cross sectional configuration.

18. An assembly according to claim 17 wherein said detachable securing means includes a pin insertable in registerable openings in said bracket, said retainer member and second section of said strut.

19. An assembly according to claim 12 wherein said second section of said strut includes an end portion received within, slidably along and having a cross sectional configuration complimentary to the cross sectional configuration of said guideway, and said detachable securing means includes a pin insertable in registerable openings in said bracket and said second section of said strut.

20. An assembly according to claim 19 wherein said end portion has a T-shaped cross sectional configuration.

21. An assembly according to claim 20 wherein said end portion includes a head segment having a cylindrical configuration and shank section, and wherein said pin is insertable in registerable openings in said bracket and said shank portion.

22. An assembly according to claim 12 wherein said arm member is provided with a pair transversely spaced wall sections, and wherein said bracket is received between said wall sections when said bracket and arm member are mounted on said handle and said strut is connected to said bracket at a point disposed furthermost from the pivotal connection between said arm member and said handle.

* * * * *